US009975741B2

(12) United States Patent
Richter

(10) Patent No.: US 9,975,741 B2
(45) Date of Patent: May 22, 2018

(54) MOBILE WORK MACHINE HAVING AN OUTRIGGER AND AN EXTENSION FOR WIDENING THE SUPPORT BASE

(71) Applicant: Liebherr-Werk Ehingen GmbH, Ehingen (DE)

(72) Inventor: Yggve Richter, Blaubeuren (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 339 days.

(21) Appl. No.: 14/729,623

(22) Filed: Jun. 3, 2015

(65) Prior Publication Data

US 2015/0344274 A1 Dec. 3, 2015

(30) Foreign Application Priority Data

Jun. 3, 2014 (DE) ..... 10 2014 008 117

(51) Int. Cl.
*B66C 23/80* (2006.01)

(52) U.S. Cl.
CPC ..... *B66C 23/80* (2013.01)

(58) Field of Classification Search
CPC ..... B66C 23/00; B66C 23/62; B66C 23/72; B66C 23/78; B66C 23/80; B66C 25/00; E02F 9/08; E02F 9/0808; E02F 9/085; B60S 9/00; B60S 9/10; B60S 9/12; B60S 9/22; B60S 11/00; E04G 21/00
See application file for complete search history.

(56) References Cited

U.S. PATENT DOCUMENTS

2013/0146557 A1 6/2013 Willim

FOREIGN PATENT DOCUMENTS

| | | | | |
|---|---|---|---|---|
| CN | 201670672 | * | 12/2010 | ..... B66C 23/80 |
| DE | 202004020169 U1 | | 3/2005 | |
| DE | 102011119654 A1 | | 5/2013 | |

* cited by examiner

*Primary Examiner* — Minh Truong
*Assistant Examiner* — Juan J Campos, Jr.
(74) *Attorney, Agent, or Firm* — McCoy Russell LLP

(57) ABSTRACT

The present disclosure relates to a mobile work machine, in particular a mobile crane, having an undercarriage and a superstructure, wherein at least one outrigger is provided at the undercarriage for supporting the work machine in a first work position, wherein the outrigger comprises at least one sliding beam box, at least one sliding beam displaceable therein and at least one outrigger cylinder provided at the sliding beam, and wherein an additional extension is provided in a second work position of the work machine, said additional extension being coupled to the work machine at least via a first connection point and a second connection point, wherein the second connection point is provided at a mount of a piston rod of an outrigger cylinder. The present disclosure is furthermore directed to a corresponding extension and to a method for adjusting a corresponding work machine.

18 Claims, 4 Drawing Sheets

PRIOR ART

MOBILE WORK MACHINE HAVING AN OUTRIGGER AND AN EXTENSION FOR WIDENING THE SUPPORT BASE

CROSS REFERENCE TO RELATED APPLICATION

This application claims priority to German Patent Application No. 10 2014 008 117.6, entitled "A Mobile Work Machine Having an Outrigger and an Extension for Widening the Support Base", filed on Jun. 3, 2014, the entire contents of which is hereby incorporated by reference in its entirety for all purposes.

TECHNICAL FIELD

The present disclosure relates to a mobile work machine having an outrigger and an extension or having a plurality of outriggers with extensions for widening the support base of the work machine. The present disclosure is furthermore directed to a method for adjusting a work machine having an extension.

BACKGROUND AND SUMMARY

It is known to give mobile work machines or work machines greater security against tilting by means of an outrigger or by means of a plurality of outriggers. This is advantageous when the work machine is set to carry out work. In this respect, there is always the conflict between a larger stability of the work machine and necessary weight savings in the designs of the work machine which are as large as possible. A telescopic sliding beam which provides greater stability for the work machine in the state telescoped out in this respect disadvantageously also increases the weight of the additional assembly or of the further sliding beam pipe.

It is therefore the object of the present disclosure to improve a work machine of the category, in particular to design its support width in a flexibly enlargeable manner, with as little additional weight as possible arising.

This object is satisfied in accordance with the present disclosure by a mobile work machine, in particular a mobile crane, having an undercarriage and a superstructure, wherein at least one outrigger is provided at the undercarriage for supporting the work machine in a first work position, wherein the outrigger comprises at least one sliding beam box, at least one sliding beam displaceable therein and at least one outrigger cylinder provided at the sliding beam, and wherein an additional extension is provided in a second work position of the work machine, said additional extension being coupled to the work machine via at least a first connection point and a second connection point, wherein the second connection point is provided at a mount of a piston rod of an outrigger cylinder.

It is thus advantageously possible to mount the extension at one or at several outriggers of the work machine in the second work position depending on the requirement. In this respect, it is also possible with respect to the vehicle longitudinal axis of the work machine to achieve different extension lengths of the outriggers or of the sliding beams to the left or to the right.

It is conceivable in a further example embodiment that the first connection point is provided at the sliding beam box and/or at a region of the undercarriage spaced apart from the outrigger.

An advantageously stable coupling of the extension or extensions to the work machine can thus be implemented. The first connection point can in this respect be designed as a simple connection point which allows a coupling of the extension only to the sliding beam box or only to a region of the undercarriage spaced apart from the outrigger. The connection point can, however, also be designed such that it simultaneously couples the extension to the sliding beam box and to a region of the undercarriage spaced apart from the outrigger.

It is conceivable in a further example embodiment that the first connection point has a pivot bearing having a pivot axis about which the extension can be pivoted.

It is possible by the pivotable outrigger of the extension about the pivot bearing to support the work machine by the pivoting of the extension with a coupled extension or to raise the outrigger by pivoting. The support with an extension can thus take place flexibly, with a force introduction which is as large as possible simultaneously being able to take place via the extension.

It is conceivable in a further example embodiment of the present disclosure that the extension can be pivoted by means of the outrigger cylinder.

The outrigger cylinder can thus advantageously be used both in the first work position to achieve a support of the work machine and in the second work position, with the support taking place via the extension here. The same actuator or outrigger cylinder can thus be used to achieve a support both with and without an extension.

It is conceivable in a further example embodiment that the pivot bearing comprises a pin and an eye or a fork. If the pin and the eye or the fork are used for coupling the extension and the work machine, the coupling can thus be carried out particularly simply and fast. The design of such a connection point or coupling point also represents a particularly simple embodiment possibility.

It is conceivable in a further example embodiment that an outrigger is provided at the extension at an end section opposite the first connection point. It is possible by means of this positioning of the outrigger to use the whole length of the extension to widen the support of the work machine. The extension is thus advantageously used in its total extent to achieve a maximum support.

It is conceivable in a further example embodiment that the extension is designed as a sheet metal construction and/or as a lattice construction and/or that a tie point is provided at the extension. The corresponding design of the extension in the construction form of a metal sheet or of a lattice allows an advantageously favorable provision of the extension with simultaneously minimized construction weight. The tie point which can be provided at the extension facilitates the transport of the extension from a storage position of the extension into a position in which the extension is coupled to the work machine in accordance with the second work position. The tie point can in this respect advantageously be positioned such that an extension which can have a substantially horizontally extending structure still remains in a substantially horizontal position or alignment or is only set slightly into rotation on suspension at the tie point and on a raising of the extension at the tie point in order to facilitate the assembly.

The present disclosure is furthermore directed to an extension for a mobile work machine in accordance with one of the claims 1 to 7 having at least two connection points for the simultaneous connection of the extension to at least two different regions of the work machine. Provision can be made in this respect that a first connection point is designed to provide a coupling between the extension and the sliding beam box and/or a region spaced apart from the outrigger. The second connection point can in contrast be designed to provide a coupling between the extension and the mount of a piston rod of an outrigger cylinder.

The present disclosure is furthermore directed to a method of adjusting a work machine, in particular a work machine as described herein, into a work position having an extension in at least one outrigger, comprising the steps:

In a first step, adjusting the work machine from a travel position into a first work position, wherein the sliding beams are traveled out from at least four outriggers and wherein at least three of the outriggers support the work machine via outrigger cylinders, piston rods and outrigger pads;

In a second step, releasing an outrigger pad from the piston rod of a sliding beam and traveling the corresponding piston rod to a designated length, wherein the work machine is still supported by the at least three piston rods not traveled in;

In a third step, transporting an extension to connection points of the work machine;

In a fourth step, coupling the extension to the work machine via the connection points;

In a fifth step, traveling the piston rod to a length for supporting the work machine by means of the extension; and repeating the steps two to five as required with further outriggers and extensions until a further work position is reached. In one example the steps are performed in the order listed above; however in alternative examples the steps may be performed in different alternative orders.

Further details and advantages of the present disclosure will now be explained in more detail with reference to embodiments shown in the Figures.

DETAILED DESCRIPTION

Figure 1:
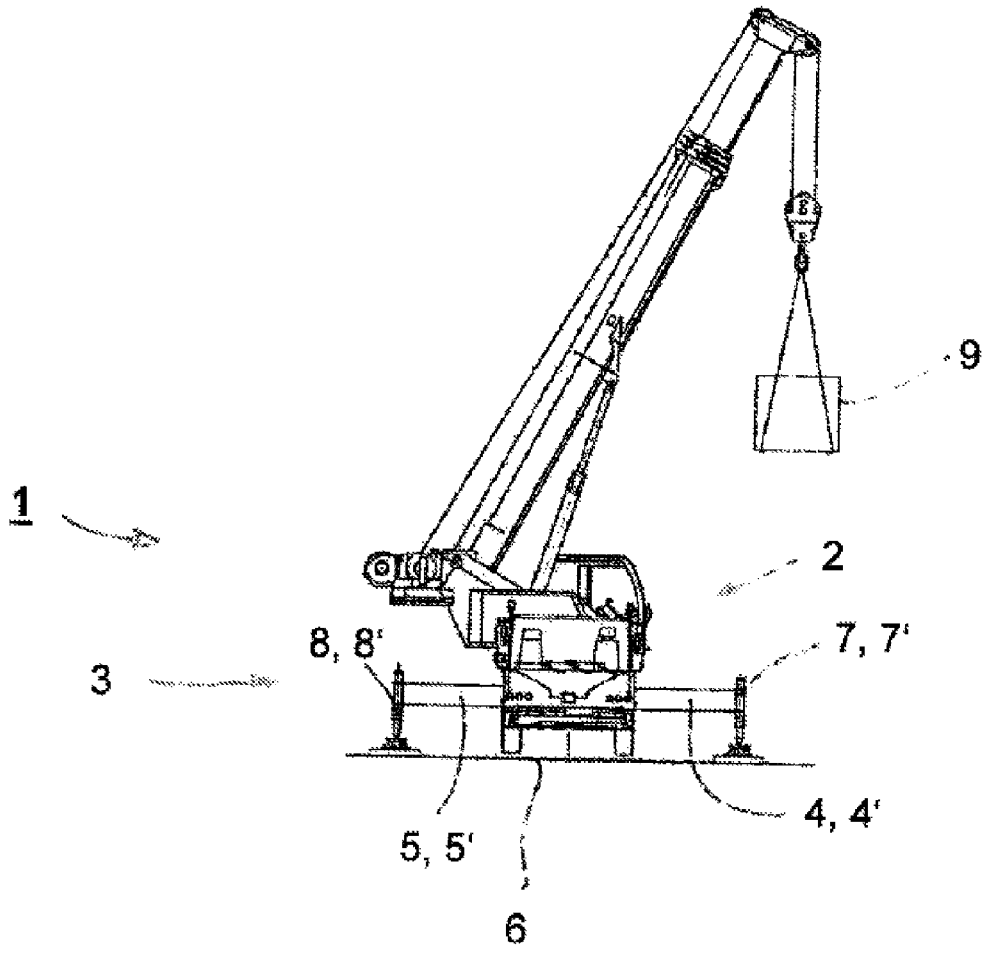
FIG. 1 shows a mobile work machine with outriggers in accordance with the prior art.

FIG. 1 shows a mobile work machine in accordance with the prior art, with it being a mobile crane 1 in the embodiment shown. The mobile crane 1 has an undercarriage 3 as well as a superstructure 2 rotatably supported thereon. A crane boom, which is lifting a load 9 in the shown embodiment of FIG. 1, is provided at the superstructure 2. In the frontal view of the mobile work machine in FIG. 1, one left and one right sliding beam 4, 4', 5, 5' are shown at whose ends a respective outrigger cylinder 7, 7', 8, 8' is provided. The work machine is in this respect supported on the ground 6 via the sliding beams 4, 4', 5, 5' and via the outrigger cylinders 7, 7', 8, 8'.

Figure 2:
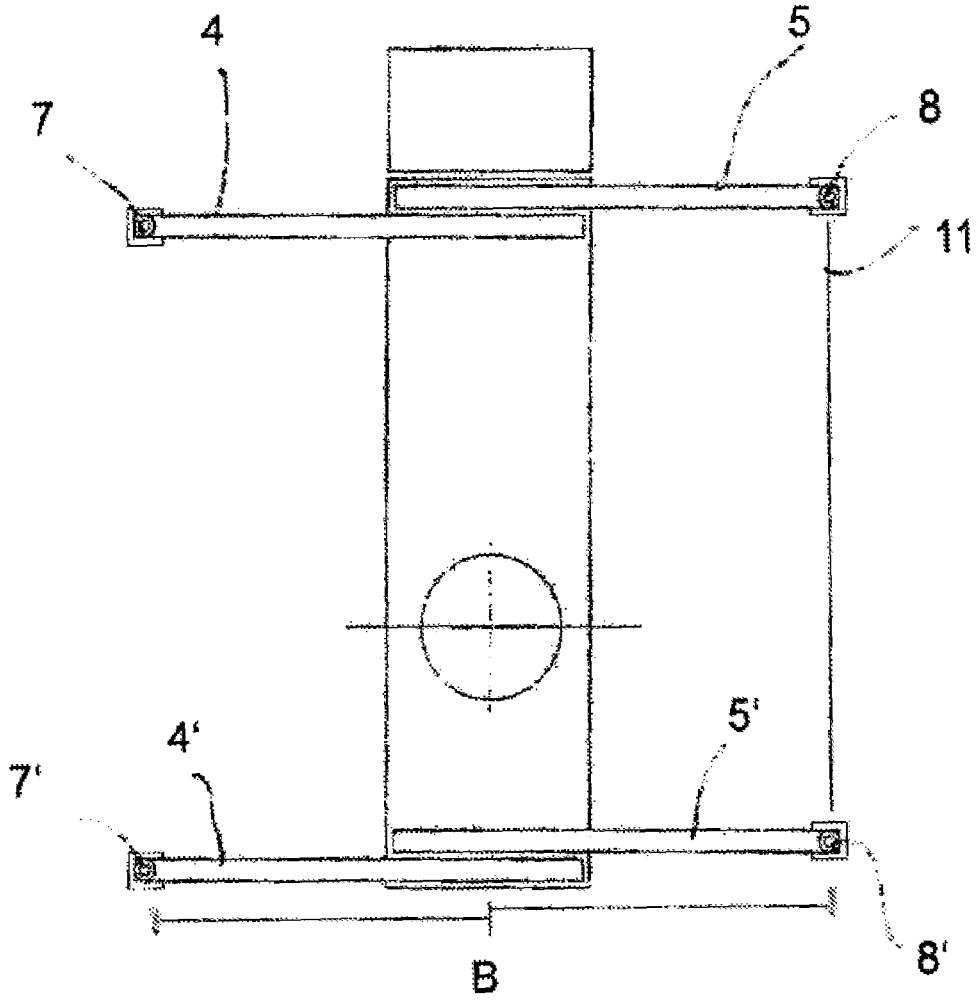
FIG. 2 shows a schematic plan view of a mobile work machine with outriggers in accordance with the prior art.

FIG. 2 shows a schematic plan view of a work machine such as shown FIG. 1, wherein the work machine is supported over a width B with respect to the ground 6 via sliding beams 4, 4', 5, 5' and via outrigger cylinders 7, 7', 8, 8'. The tilt edge 11 in this respect results from the width B.

As a rule, with smaller cranes, only one sliding beam 4, 4', 5, 5' to be slid out of the sliding beam box 30 is used. The support width B is therefore dependent on the width of the mobile crane 1 and the length of the sliding beam box 30 and thus on the sliding beams 4, 4', 5, 5' which can be slid out and is limited at approximately 6.3 m. With a mobile crane 1 having an H outrigger shown in FIG. 2, the support width B is thus limited by the maximum vehicle width in the travel state of the mobile crane 1.

With larger cranes, as a rule two sliding beam segments are used which can be slid into one another, with the maximum support width B being limited to approximately 9.6 m.

Figure 3:
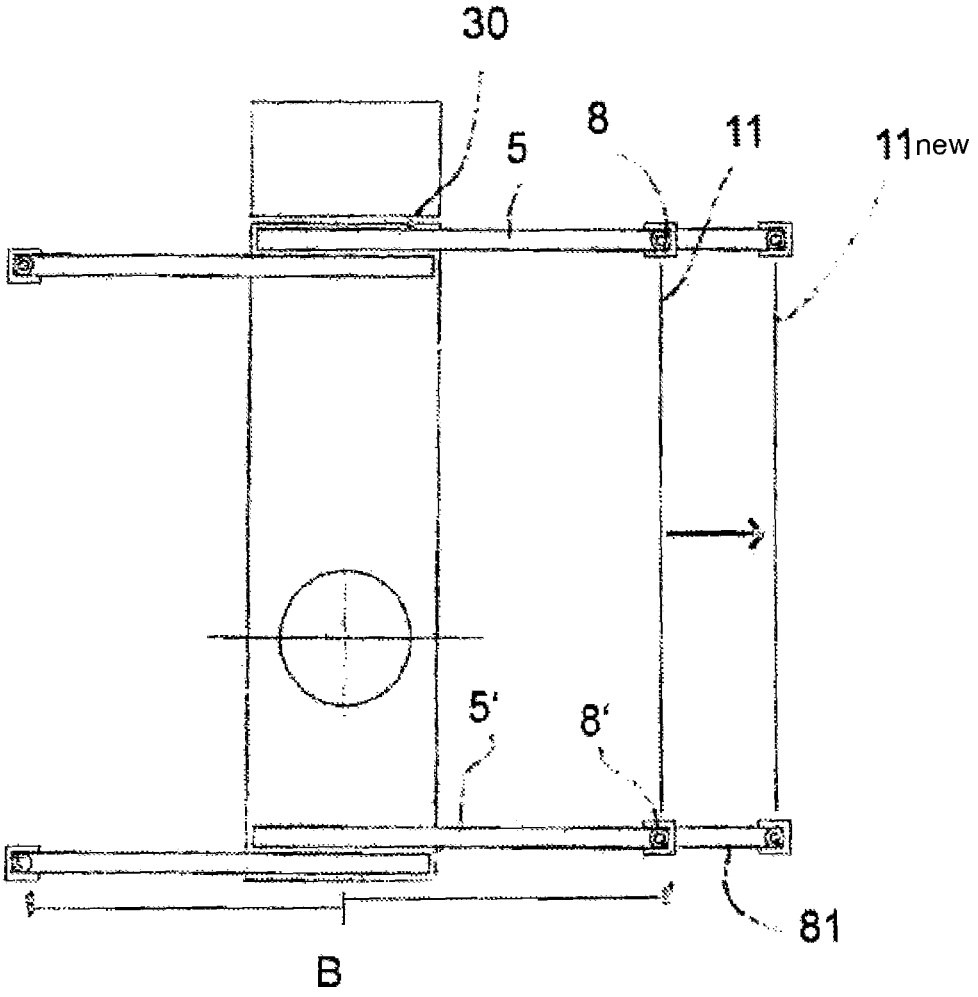
FIG. 3 shows a schematic plan view of a work machine with an outrigger in accordance with the present disclosure.

FIG. 3 shows a possibility for the enlarging in accordance with the present disclosure of the support width B by means of attachment of extensions 81 to the work machine. In the embodiment of FIG. 3 shown, two extensions 81 are in this respect coupled to the right side of a mobile crane or to its right outriggers. The extensions 81 in this respect produce a new tilting edge 11 new further away from the longitudinal axis of the mobile crane 1 at the right side. For example, the additional structure described with regard to FIGS. 3-4 may, in one example embodiment, be added to the mobile crane 1 of FIG. 1.

Figure 4:
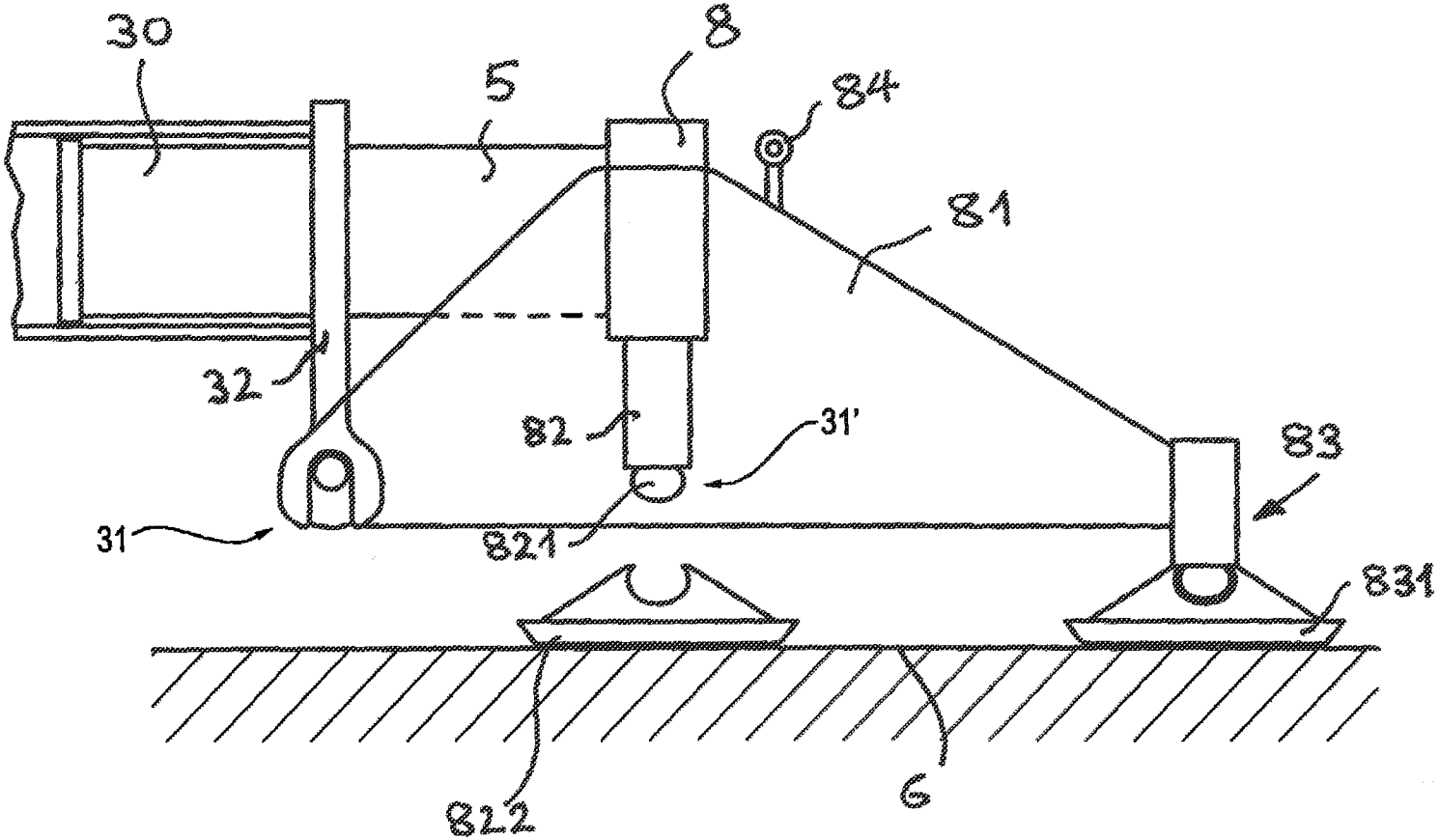
FIG. 4 shows a detail of an outrigger and extension in accordance with the present disclosure.

FIG. 4 shows how the extension 81 is coupled to the mobile crane 1 via first and second connection points 31, 31'. The extension 81 is in this respect coupled to the sliding beam box 30 via the first connection point 31. For this purpose, the extension 81 can be releaseably coupled to a collar 32 of the sliding beam box 30 via the first connection point 31. It is in this respect additionally or alternatively conceivable that the extension 81 is directly coupled to the undercarriage construction via the first connection point 31. The second connection point 31' is coupled to the piston rod 82 via a mount 821.

The extension 91 supports an outrigger 83 at the end opposite the first connection point 31, the outrigger being suitable to lead off to the ground the total load of the mobile crane and of the load 9 to be taken up or the total load which is introduced into the corresponding outrigger of the mobile crane 1. As known, an outrigger pad 831 can be used. The term outrigger can typically comprise the components sliding beam box 30, sliding beams, 4, 4', 5, 5', outrigger cylinders 7, 7', 8, 8' and the corresponding outrigger pads 822 and 831 respectively. The outrigger pads 822 and 831 respectively can also lie on so-called mats not shown in any more detail in FIG. 4. The mats serve in a known manner for a better-distributed force introduction into the ground. They can optionally form a transport unit with the outrigger pads, whereby the assembly is also simplified.

The first connection point 31 has a pivot axis about which the total extension 81 can be pivoted. This can be implemented via a pin and an eye or a fork.

The mount 821 which is present at the outrigger cylinder 7, 7', 8, 8', which is in particular of spherical shape, is received at the second connection point 31'. The outrigger cylinder 7, 7', 8, 8' hereby remains active and can pivot the extension 81 about the first connection point 31.

The total crane 1 can be aligned in accordance with the crane control anyway present. It is also ensured that all the axes of the mobile crane 1 have raised or can be raised from the ground 6.

It is also conceivable to provide a modification of the collar 32 at the sliding beam box 30, whereby the first connection point 31, which includes the pivot axis essential for function, can be brought into a suitable position.

The terms first and second connection points 31, 31' can in this respect relate to components which are provided at the extension 81 and at further regions of the undercarriage 3 of the mobile crane 1 such as at the sliding beam box 30 or at other regions of the undercarriage 3. A tie point 84 which is provided for assembly purposes is furthermore shown in FIG. 4.

The invention claimed is:

1. A mobile work machine, comprising:

an undercarriage and a superstructure, wherein at least one outrigger is provided at the undercarriage for supporting the work machine in a first work position, wherein each outrigger comprises at least one sliding beam box, at least one sliding beam displaceable therein, and at least one outrigger cylinder provided at the sliding beam, and wherein an additional extension is provided in a second work position of the work machine, said additional extension being coupled to the work machine at least via a first connection point and a second connection point, wherein the first connection point is provided at the sliding beam box and/or at a region of the undercarriage spaced apart from the outrigger, and wherein the second connection point is provided at a piston rod of the outrigger cylinder.

2. The mobile work machine in accordance with claim 1, wherein the first connection point has a pivot bearing having a pivot axis about which the additional extension is pivotable.

3. The mobile work machine in accordance with claim 2, wherein the additional extension is pivotable via the outrigger cylinder.

4. The mobile work machine in accordance with claim 3, wherein the pivot bearing comprises a pin and an eye or a fork.

5. The mobile work machine in accordance with claim 1, wherein an outrigger is provided at the additional extension at an end section opposite the first connection point.

6. The mobile work machine in accordance with claim 1, wherein the additional extension is designed as a sheet metal construction; and/or in that a tie point is provided at the additional extension.

7. The mobile work machine in accordance with claim 1, wherein the outrigger comprises outrigger pads which are transportable with mats on which the outrigger pads are arranged.

8. The mobile work machine in accordance with claim 1, wherein the work machine is a mobile crane.

9. A method of adjusting a work machine having an undercarriage and a superstructure, wherein at least one outrigger is provided at the undercarriage for supporting the work machine in a first work position, wherein the outrigger comprises at least one sliding beam box, at least one sliding beam displaceable therein, and at least one outrigger cylinder provided at the sliding beam, and wherein an additional extension is provided in a second work position of the work machine, said additional extension being coupled to the work machine at least via a first connection point and a second connection point, wherein the first connection point is provided at the sliding beam box and/or at a region of the undercarriage spaced apart from the outrigger, and wherein the second connection point is provided at a piston rod of the outrigger cylinder, into a work position, comprising the steps:

in a first step, adjusting the work machine from a travel position into the first work position, wherein the sliding beams are traveled out from at least four outriggers and wherein at least three of the outriggers support the work machine via outrigger cylinders, piston rods and outrigger pads;

in a second step, releasing an outrigger pad from the piston rod of a sliding beam and traveling the corresponding piston rod to a designated length, wherein the work machine is still supported by the at least three piston rods not traveled in;

in a third step, transporting an extension to connection points of the work machine;

in a fourth step, coupling the extension to the work machine via the connection points;

in a fifth step, traveling the piston rod to a length for supporting the work machine via the extension; and repeating the steps two to five as required with further outriggers and extensions until a further work position is reached.

10. The method of claim 9, wherein the first connection point has a pivot bearing having a pivot axis about which the additional extension is pivotable.

11. The method in accordance with claim 10, wherein the additional extension is pivotable via the outrigger cylinder, and wherein the pivot bearing comprises a pin and an eye or a fork, and wherein an outrigger is provided at the additional extension at an end section opposite the first connection point.

12. The method in accordance with claim 11, wherein the additional extension is designed as a sheet metal construction; and/or in that a tie point is provided at the additional extension, and wherein the outrigger comprises the outrigger pads which are transportable with mats on which the outrigger pads are arranged.

13. A mobile work machine, comprising:

an undercarriage; and a superstructure mounted to the undercarriage, wherein at least one outrigger is provided at the undercarriage for supporting the work machine in a first work position, wherein the outrigger comprises at least one sliding beam box, at least one sliding beam displaceable therein, and at least one outrigger cylinder provided at the sliding beam, and wherein an additional extension is provided in a second work position of the work machine, said additional extension being coupled to the work machine at least via a first connection point and a second connection point, wherein the second connection point is provided at a piston rod of the outrigger cylinder, wherein the outrigger comprises outrigger pads which are transportable with mats on which the outrigger pads are arranged, wherein the first connection point is provided at the sliding beam box and/or at a region of the undercarriage spaced apart from the outrigger, and wherein the work machine is a mobile crane.

14. The mobile work machine in accordance with claim 13, wherein the first connection point has a pivot bearing having a pivot axis about which the additional extension is pivotable.

15. The mobile work machine in accordance with claim 14, wherein the additional extension is pivotable via the outrigger cylinder.

16. The mobile work machine in accordance with claim 15, wherein the pivot bearing comprises a pin and an eye or a fork.

17. The mobile work machine in accordance with claim 16, wherein an outrigger is provided at the additional extension at an end section opposite the first connection point.

18. The mobile work machine in accordance with claim 17, wherein the additional extension is designed as a sheet metal construction; and/or in that a tie point is provided at the additional extension.

* * * * *